United States Patent [19]

Hutzenlaub et al.

[11] 4,160,529

[45] Jul. 10, 1979

[54] ROLLER WINDING MACHINE FOR THE FORMATION OF SINGLE REELS

[76] Inventors: Armin S. P. Hutzenlaub, Am Stichelberg 24; Klaus Pack, Im Sonnenwinkel 16, both of 5276 Wieh-l, Fed. Rep. of Germany

[21] Appl. No.: 911,047

[22] Filed: May 30, 1978

[30] Foreign Application Priority Data

Jun. 2, 1977 [DE] Fed. Rep. of Germany ..... 2724955

[51] Int. Cl.[2] ..... B65H 35/04; B65H 75/34

[52] U.S. Cl. ..... 242/56.6; 242/64; 242/74

[58] Field of Search ..... 242/56.2, 56.3, 56.4, 242/56.5, 56.6, 56.7, 56 R, 56.9, 67.1 R, 74, 64

[56] References Cited

U.S. PATENT DOCUMENTS

| | | | |
|---|---|---|---|
| 2,364,888 | 12/1944 | Aycock | 242/56.6 |
| 2,664,139 | 12/1953 | Speed | 242/56.6 X |
| 3,172,612 | 3/1965 | Besserdich | 242/56.6 X |
| 3,599,888 | 8/1971 | Coudriet | 242/64 |
| 3,784,122 | 1/1974 | Kataoka | 242/64 |

*Primary Examiner*—Edward J. McCarthy
*Attorney, Agent, or Firm*—Bacon & Thomas

[57] ABSTRACT

The roller winding machine for the formation of individual reels from longitudinally cut material bands comprises a sickle-shaped supporting and cutting table which is capable of being pivoted between a carrying roll and the material band if the material band is to be cut crosswise. The cutting of the material band is carried out in a precisely defined position upon the supporting and cutting table. One or more adhesive-label issue devices also cooperate with the supporting and cutting table. By means of the adhesive labels, the beginning of the band is fastened to the empty reel sleeve, and the band end is fastened to the full reel, respectively.

10 Claims, 11 Drawing Figures

Figure 1:
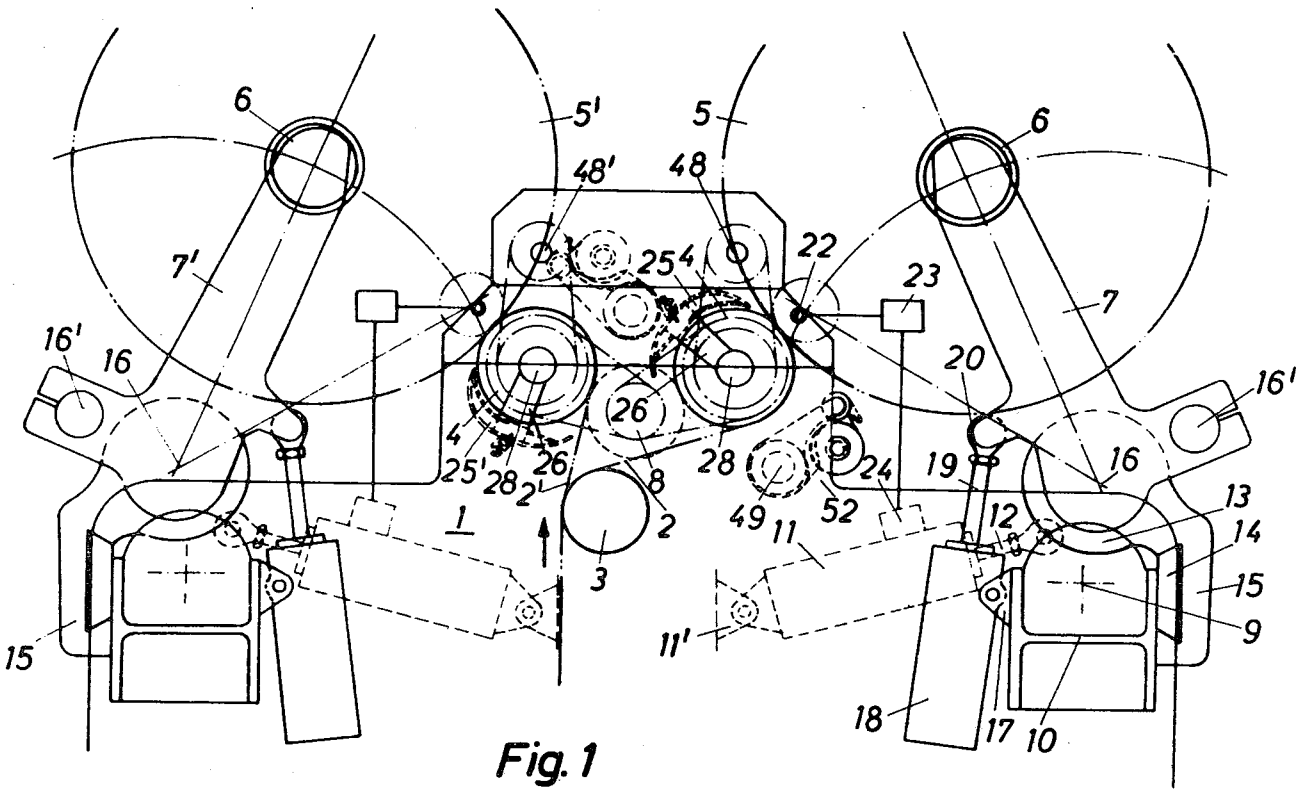

The receiver 11' is mounted on the shield plate 1 of the machine frame

ROLLER WINDING MACHINE FOR THE FORMATION OF SINGLE REELS

The invention relates to a roller winding machine for the formation of single reels of longitudinally cut material bands.

In the fabrication of individual reels of longitudinally cut material bands, a frequent stopping of the machine for the removal of the specific individual reels is necessary. The users of such a machine demand that it should be possible to produce individual reels of different length. In spite of many proposals the roller change is a very intricate and troublesome work, resulting in long periods of standstill.

It is the object of the invention to provide a roller winding machine which, independent of the specific reel size, renders possible a quick and automatic change of the full reel in exchange for an empty reel sleeve. In this connection a safe and precise cross-cutting of the material band and an exact sticking of the end of the band on the full reel and of the beginning of the band on the empty reel sleeve are of particular importance.

This object is solved in the case of a roller winding machine for the formation of individual reels of longitudinally cut material bands, having, at least, one carrying roll, rotable about a frame-fixed axle, and having swing arms, slidable on a bridgepiece and associated with the carrying roll each in pairs, for the reception of one reel sleeve each, as well as with relief and/or pressure devices, respectively, for the swing arms as well as with a crosscutting device for the material band, in that a sickle-shaped supporting and cutting table, capable of being swung concentrically to the carrying roll, stands in a waiting position outside of the path of the material band and is adapted to be swung into operating position between the material band and the supporting arch of the carrying roll under the lifting of the material band, the reel sleeve with the reel being capable of being lifted in each case simultaneously in accordance with the thickness of the cutting table, and that there is movable a cutting carriage within the supporting and cutting table in a slot in parallel with the axle of the carrying roll.

The supporting and cutting table secures in connection with the lifting motion of the full reels a precise cutting position for the crosscutting. The crosscutting is carried out upon the cutting table so that a safe base for the cutting blade and, thus, a proper cutting result are guaranteed. In order to guarantee a careful working and a safe taking along of the adhesive tape also in the case of corrugations of the material band, or in the case of out-of-roundness of the reel sleeves, the surface of the cutting table is provided elastically and is covered, e.g., with a rubber cushion.

The lifting movement of the full reels renders it possible, to use this cutting table in the immediate vicinity of the winding position and of the carrying roll.

For the precise control of the lifting movement of the swing arms for the reel sleeve and/or the reel, respectively, particular measures are provided. The additional lifting cylinder enables a precise approaching of the width of the working gap, because the lifting cylinder is extended in each case thus far till the lifting movement is interrupted by the signal released by a light barrier. In this lifting movement the relief cylinders are moved back automatically into their inoperative positions up to the stop of the piston rod. Consequently, an extensive position control is not required for the lifting movement.

A further development of the invention provides, adhesive-lable issue devices. Therewith a plurality of adhesive-label issue devices may be distributed across the band width of each single reel. The adhesive-label issue devices are pressed against the material band around a swivelling shaft in a corresponding relation to the stopping of the material band so that in each case an adhesive label, adherent on both sides, is applied before and under the crosscutting position to the band strip. Such adhesive label secures in each case that the band end is fastened upon the full reel and/or the beginning of the band is connected with the empty reel sleeve, respectively.

The suction chamber of the supporting and cutting table secures a retaining of the separated band end. In the swivelling of the supporting and cutting table from the working position to the waiting position in accordance with the starting of the empty reel sleeve by this suction chamber the beginning of the band is taken along so that a safe starting of the winding operation is guaranteed.

Figure 2:
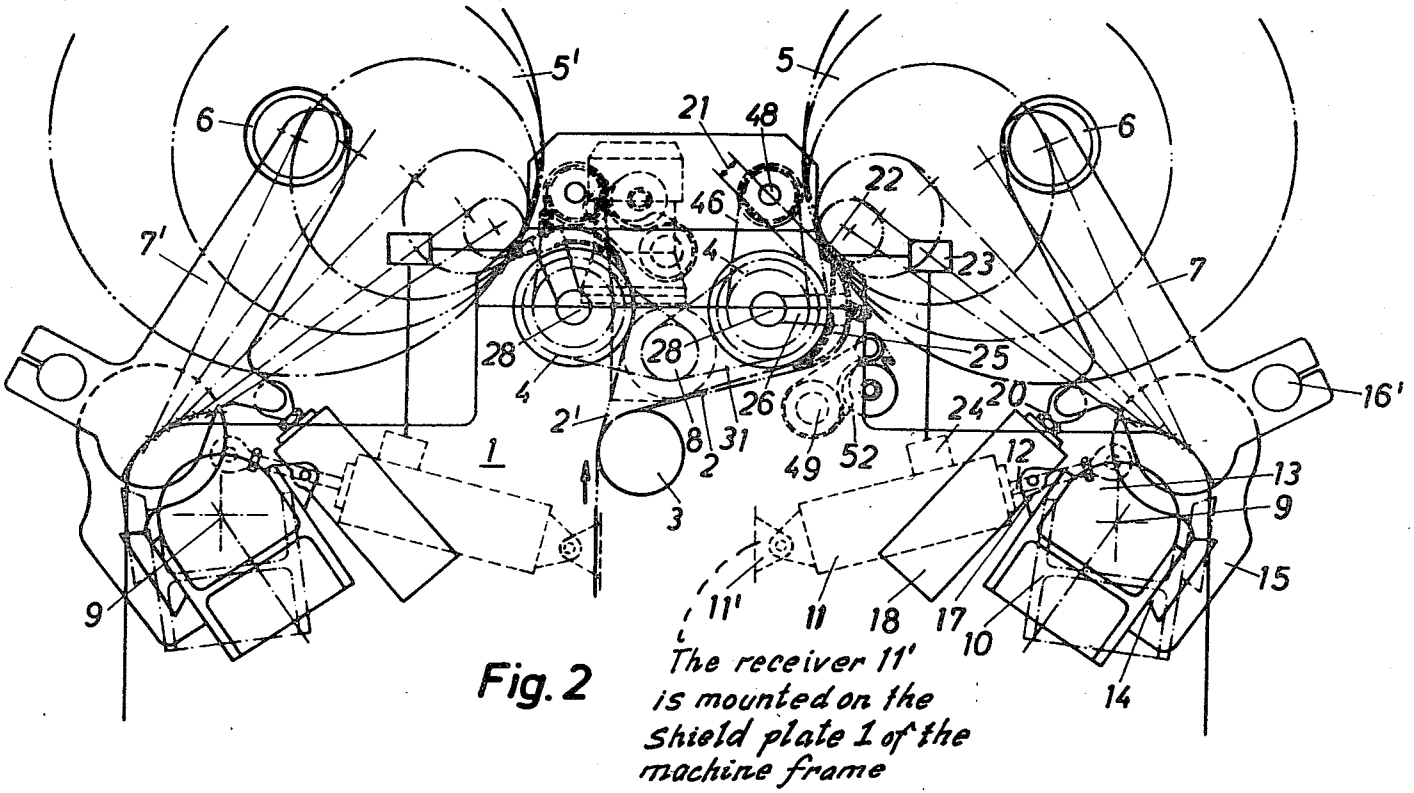
Figure 3:
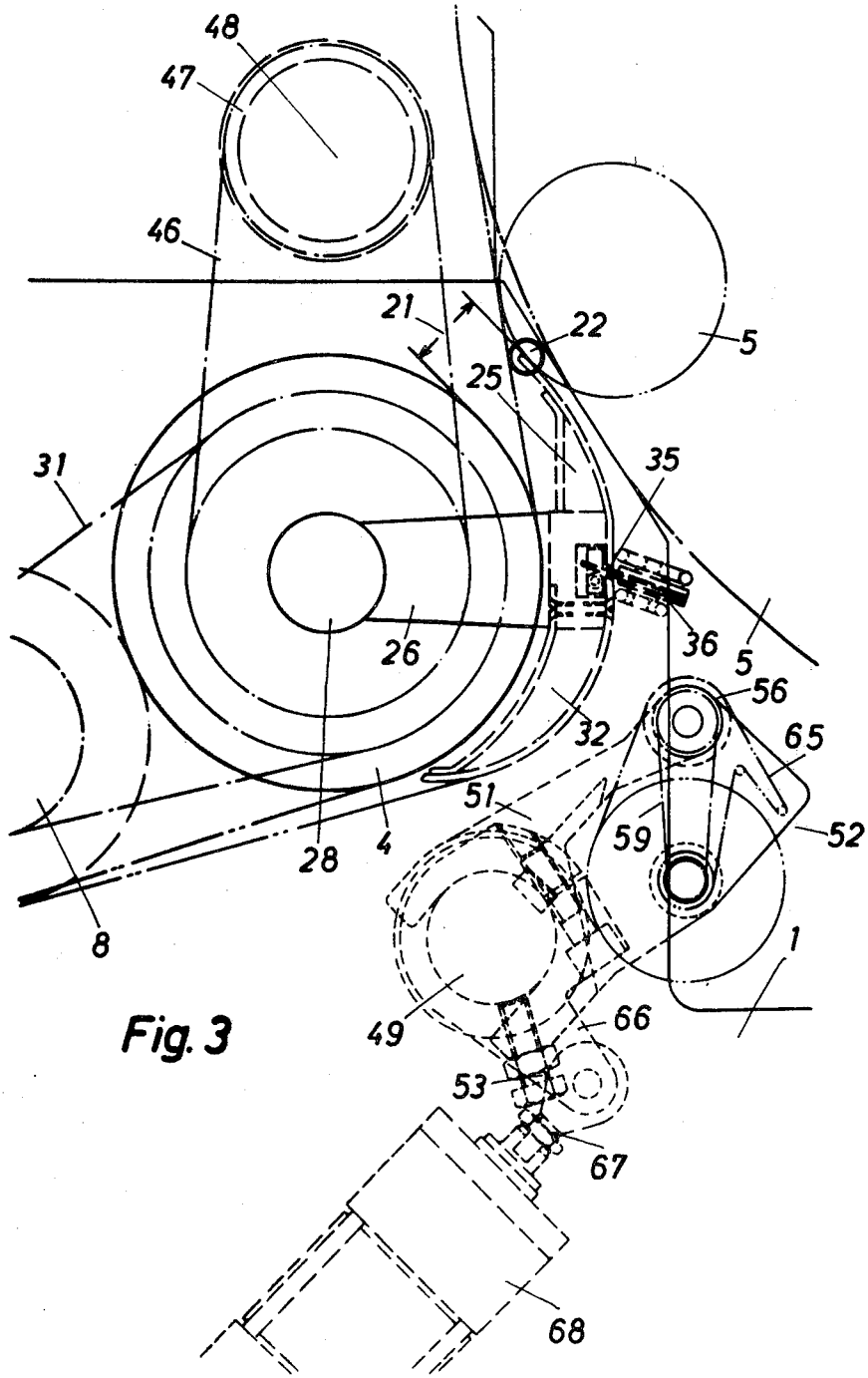
Figure 4:
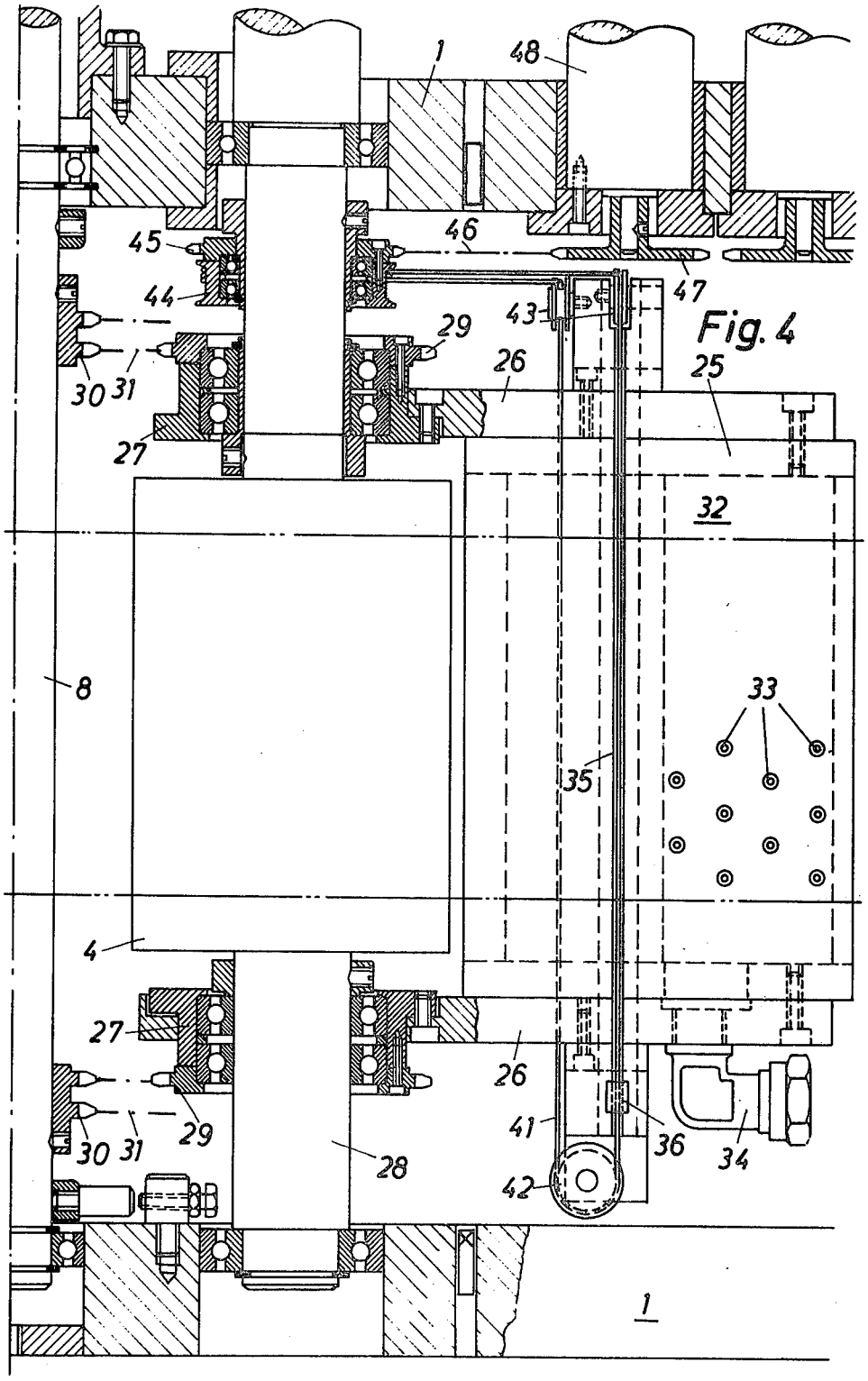
Figure 5:
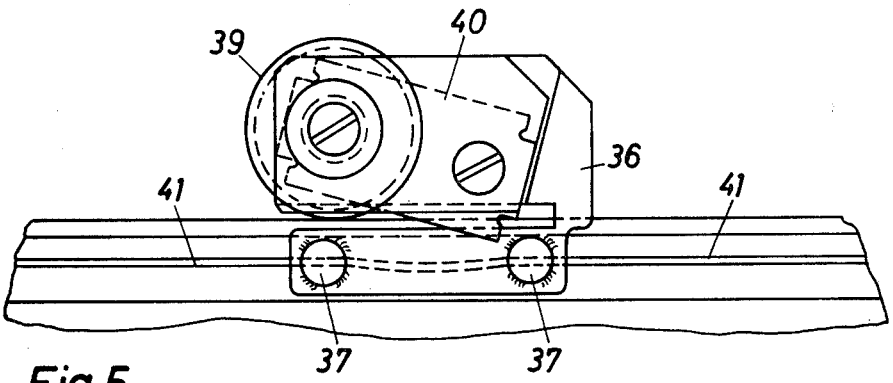
Figure 6:
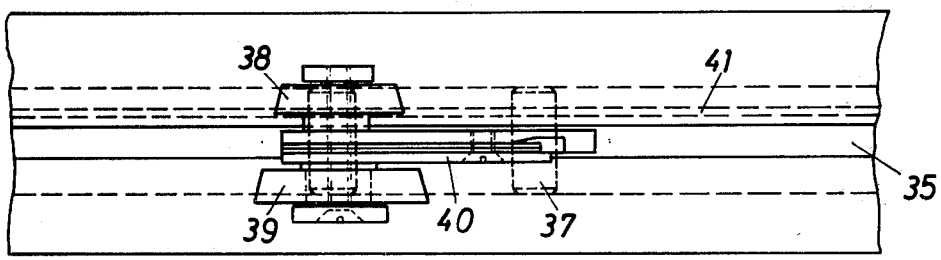
Figure 9:
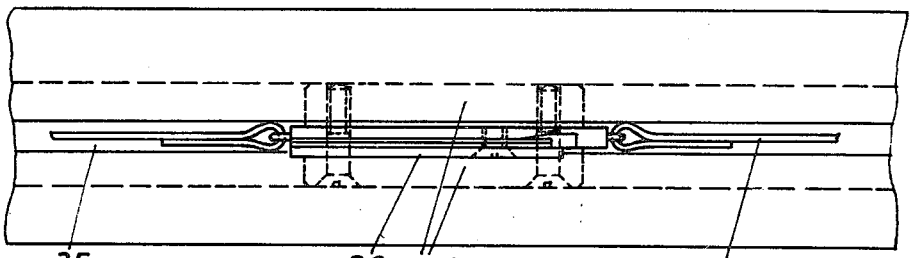
Figure 10:
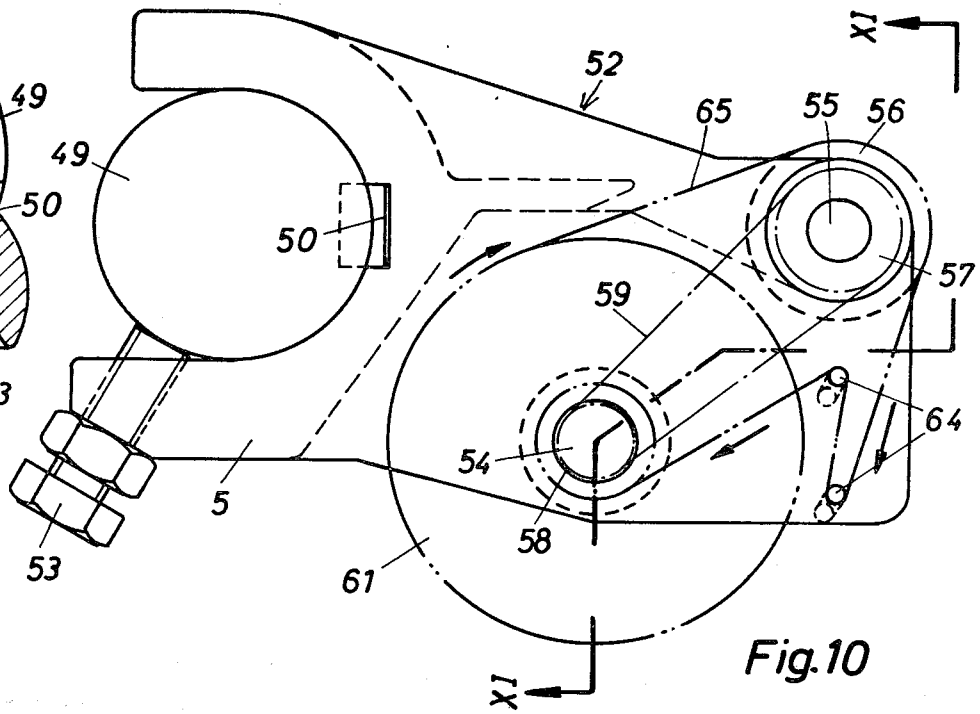
Figure 11:
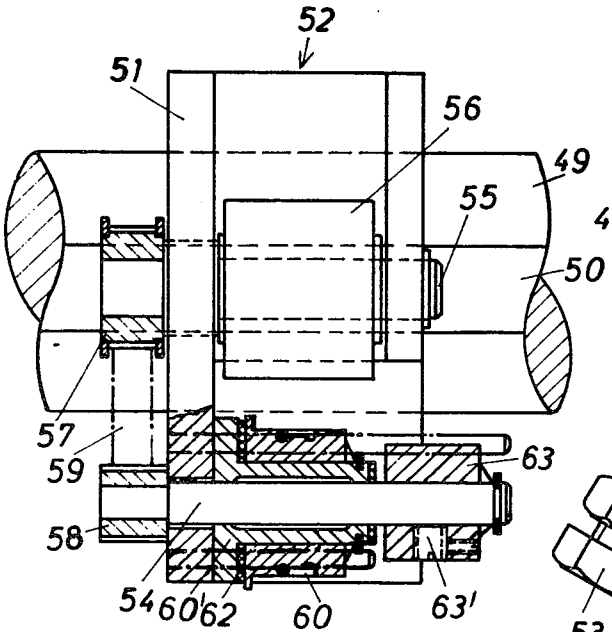

One embodiment of the invention will be described in the following with reference to the attached drawings, wherein FIG. 1 is a total view of the roller winding machine according to the invention in the winding position, FIG. 2 is a corresponding total view in the lifting position for the crosscutting and the reel change, FIG. 3 is an enlarged single view of the working position of a supporting and cutting table, FIG. 4 is a top view of the carrying roll with a supporting and cutting table in a prolated illustration, FIG. 5 is an enlarged single view of a cutting carriage, FIG. 6 is a top view of FIG. 5, FIGS. 7–9 show different views of a further embodiment of a cutting carriage, FIG. 10 is a single view of an adhesive-label issue device, and FIG. 11 is a section taken on the line XI–XI in FIG. 10.

The roller winding machine according to the invention comprises a machine frame with shield plates 1 arranged oppositely to one another, between which the shafts and other portions of the roller winding machine are situated. In the Figures there is illustrated just the winding-on portion of the machine, because the invention merely relates to such portion. The winding off, possible broad-drawing rolls, deviating rollers as well as the device for longitudinal cutting are not shown. Subsequent to device for longitudinal cutting the longitudinally cut strips 2 of the material band are moved in the direction of the arrow. Strips 2 and 2' each adjacent to one another are deviated via a deviating roller and alternately guided to carrying rollers 4 and 4', against which reels 5 of reel sleeves 6 abut in each case. Each reel sleeve 6 is kept in the grip holders of a pair of swing arms 7, 7'. This arrangement is usual in winding engineering. The shaft 28 of each carrying roll 4, 4' is driven by a motor, not shown.

Between the shield plates 1 there is associated a bridgepiece 10 capable of being swung about an axle 9, with each carrying roll 5 and/or 5', respectively. A swivelling of the bridgepiece 10 as a whole is possible by means of one or more hydraulic cylinders 11 which are kept in receivers 11' of the shield plate 1 or of another frame part, and the piston rod 12 of which is pivoted on a shoulder 13 of the bridgepiece 10. The bridgepiece 10 comprises a guide rail 14, upon which, in each case, bearing blocks 15 are arranged in a slidable and lockable manner. A swing arm, pivotable about an axle 16, is supported on each bearing block 15. Two bearing blocks 15 each, with a pair of swing arms 7, belong together, the two swing arms 7 being coupled with each other by a connecting rod 16. On a projection 17 of each bearing block 15 there is pivoted an air cylinder 18, the piston rod 19 of which being coupled with the associated swing arm 7. The piston rod 19 comprises a stop collar 20. The air cylinders 18 render possible in each case an individual adjustment of the relief pressure or of the contact pressure, respectively, for the individual reels 5. The hydraulic cylinders 11 make possible a pivoting of the bridgepiece 10 as a whole and, thus, a common lifting movement of all reels 5 from the carrying roll 4. In this lifting movement the bridgepiece 10 is initially swivelled thus far till the stop collars 20 of the piston rods 19 abut the associated air cylinder, whereupon a further swivelling is performed and the reels 5 are lifted from the associated carrying roll 4 so that there is formed a gap 21, cf. FIG. 2.

In the range of this gap there is provided a light barrier 22 which is adjusted in accordance with the desired width of the gap 21. The light barrier 22 acts upon a control stage 23 which controls the control part 24 of the hydraulic cylinder 11 and interrupts the swivelling motion of the bridgepiece 10 in each case at such a moment when the light barrier 22 determines the achieving of the predetermined width of the gap 21.

There is associated with each carrying roll 4 a supporting and cutting table 25 which has a sickle-shaped cross section and is provided on supporting arms 26 which are attached to bearing housings 27. The bearing housings 27 are rotatably supported on the axle 28 of the carrying roll 4. Each bearing housing 27 carries, in addition, a chain wheel 29 which is directed to a chain wheel 30 of a setting shaft 8. The chain wheels 29 and 30 are connected with one another by chains 31 or toothed belts. The setting shaft 8 is connected with driving means, not shown, which renders possible a rotation of the setting shaft 8 and, thus, a swivelling operation of the two supporting and cutting tables 25 and/or 25', respectively.

FIG. 1 shows the supporting and cutting tables 25 and 25' in the waiting position; FIG. 2 shows same in the operating position, to which same are pivoted by means of the setting shaft 8. In the operating position of the supporting and cutting tables 25 and 25', respectively, the reels 5 and/or the reel sleeves 6 are lifted in accordance with the width of the gap 21 so that the supporting and cutting table 25 and/or 25', respectively, can be swivelled in each case across a corresponding circumferential portion of the carrying roll 4 under the lifting of the strips 2 and/or 2', respectively, of the material band. The supporting and cutting table 25 extends across the complete axial length of the carrying roll 4, 4'and, thus, across the complete working width of the roller winding machine.

The supporting and cutting table 25 is illustrated in FIG. 4 as a top view. At least, a portion of the supporting and cutting table 25 possesses a suction chamber 32 having a plurality of suction ports 33. The suction chamber 32 is provided with a pipe connection 34 for a suction pipeline, not shown. The suction chamber 32 is situated towards the moving direction of the strips 2 of the material band. Furthermore, there is provided within the supporting and cutting table 25 a slot 35 transversely to the moving direction of the material band. Within that slot 35 there is guided a cutting carriage or slide 36, which is illustrated in details in FIGS. 5 and 6. The cutting carriage 36 is guided within the slot 35 by sliding pins 37 and on the outer surface of the cutting table by rollers 38, 39. Within the cutting carriage 36 there is held a cutting blade 40. The ends of a traction rope 41 are attached to the sliding pins 37, which traction rope runs via deviating rollers 42, 43 and is guided to a driving drum 44 which is rotatably supported on the shaft 28. The driving drum comprises, in addition, a chain wheel 45 for a drive chain or a toothed belt 46 which is guided via a further chain wheel 47 which is provided on a driving shaft 48 which is supported in a shield plate 1. The surface of the supporting and cutting table is elastically provided and is covered, e.g., by a rubber cushion.

Figure 7:
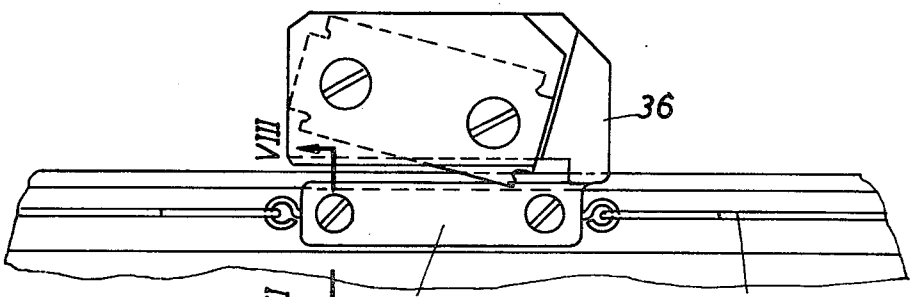
Figure 8:
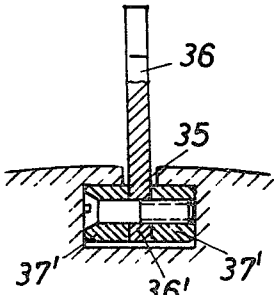

FIGS. 7 through 9 show an embodiment of the cutting carriage 36. On the foot portion 36', extending into the slot, there are provided on both sides sliding shoes 37' which guide the cutting carriage 36 within the guide section of the slot 35.

In parallel with the axle 28 there is supported, between the shield plates 1, a swivelling shaft 49 which is illustrated in an enlarged partial view in FIGS. 10 and 11. The swivelling shaft 49 comprises a guide key 50. A carrier 51 of an adhesive-label issue device 52 is slidable in the axial direction of the swivelling shaft 49 and is aligned in each case by the guide key 50. By means of the tightening screw 53 it is possible to clamp the adhesive-label issue device. The carrier 51 takes up a shaft 54 as well as a shaft 55 for a pressure and deviating roller 56.

The shafts 54 and 55 are coupled with each other via belt pulleys 57, 58 and a driving belt 59. There is provided a bushing 60' on the shaft 54, which bushing is fastened to the carrier 51. On the bushing 60' there is rotatably supported a hub 60 for a winding-off hub 61 which is decelerated by a brake disk 62. Moreover, there is provided on the shaft 54 a winding-on hub 63 which is moment-dependently coupled with shaft 54 by means of a friction pin 63'. Finally, the carrier 51 comprises two guide pins 64, aligned in an inclined or wind-tipped manner, respectively, in regard to the axis of the shaft 54. There is guided a carrier band 65 from the winding off hub 61 via the pressure and deviating roller 56 and via the guide pins 64 to the winding-on hub 63, where the carrier band is wound up. The guide pins 64 provide for a parallel displacement of the carrier band 65. There are provided on the carrier band 65, at predetermined distances, individual adhesive labels which are capable of being transferred to the specific strip 2 or 2', respectively, of the material.

The swivelling shaft 49 may incorporate a plurality of adhesive-label issue devices 52. Same may be adjusted across the working width of the machine in a manner as necessary in the specific case so that each strip of the material band can be equipped with one or more adhesive labels. The length of the individual adhesive labels is smaller than 20 mm., so that in all cases a safe pressing-on of the adhesive labels is guaranteed. The swivelling shaft 49 carries a swivelling arm 66, to which there is pivoted a piston rod 67 of a cylinder unit 68. By means of this cylinder unit 68 it is possible to swing the swivelling shaft 49 counterclockwise, related to FIG. 3, so that the pressure and deviating roller 56 is pressed against the specific strip of the material band. Consequently, the adhesive label running over the pressure roller at the time is transferred to the material band. The drive of the winding-on hub 63 is carried out by the pressure roller 56 via the driving belt 59. The swinging motion by the cylinder unit 68 is coupled with the operational mode of the roller winding machine and is coordinated with the distance of the adhesive labels on the carrier band 65. The mode of operation of the roller winding machine is described in detail in the following:

During the winding operation the structural elements are in the position evident from FIG. 1. The supporting and cutting tables 25, 25' are in the illustrated waiting position. The reels 5 are lifted via the swing arms 7, 7' by means of the air cylinders 18 in compliance with the increase of the reel diameter so that there always exists the desired contact pressure at the carrying rolls 4, 4' and a proper winding is achieved. This control of the winding operation is known.

As soon as the band length as set in each case is wound-on upon the reels 5, the running of the machine is stopped. During the deceleration of the material band, the swivelling shaft 49 is swivelled by the cylinder unit 68 in counterclockwise direction so that the pressure roller 56 is pressed against the material band still moving and against the carrying roll 4. The duration of this swivelling motion is coordinated with the velocity of the material band and the space of the adhesive labels present on the carrier band 65. According to the quantity of the adhesive-label issue devices 52, adjusted to the width of a strip, a quantity of adhesive labels having a length of less than 20 mm., is transferred to the band strip. The phase of the pressure movement is coordinated with the decelerating operation of the machine in such a manner that the range of the strip of the material band taking up the adhesive label is before the designated crosscutting line and is pressed against still at the penultimate layer of the reel 5. The shaft 49 is pressed against a second time so that in each case a further adhesive label is applied behind the designated cross cutting line, which label, thus, is at the beginning of the band for the new reel. After the deceleration or overlapping with the deceleration, there is acted upon the hydraulic cylinders 11 which swivel the bridgepiece 10 about the axle 9 in clockwise direction. In accordance with this swivelling, initially the piston rods 19 of the air cylinders 18 are moved into the cylinder chamber, till the stop collar 20 abuts the cylinder wall. With a further swivelling of the bridgepiece 10, the swing arms 7, 7' rest in a form-locking manner upon the air cylinders 18 and are lifted together with same. In accordance with this lifting motion, a gap 21 becomes free between the reel 5 and the associated carrying roll 4. As soon as the predetermined width of this gap 21 is reached, the light barrier 22 applies a signal which, via the control stage 23, acts upon the control portion 24 of the hydraulic cylinders 11 and blocks same so that the bridgepiece 10 stops in the position, evident from FIG. 2, for the roller change.

In FIG. 2, the mutual positions of reel 5 and carrying roll 4 for different reel diameters are drawn in. It is evident that, for each reel diameter, the gap 21 is precisely adjustable. It is important in the sense of the invention that the swing arms 7, 7' move into the air cylinders 18 as far as the stop collar 20 of the piston rods 19 so that the lifting gap is determined solely by the hydraulic cylinders 11. The swivelling movement is terminated exclusively by the signal of the light barrier 22.

The supporting and cutting tables 25, 25' can be pivoted into the gap 21. The swivelling operation is carried out jointly, by a corresponding turning of the setting shaft 8, whereby the supporting and cutting tables 25 are swivelled in clockwise direction. Thereby the material band is lifted from the circumferential area of the carrying roll 4 and 4', respectively. The supporting and cutting tables 25, 25' are moved into the working position, illustrated in FIG. 2.

Now the crosscutting of the material band is carried out in that in each case, via the driving shaft 48, 48', the traction rope 41 of the cutting carriage 36 is moved. The cutting carriage 36 is pulled across the complete width of the supporting and cutting table 25 and thereby splits the material band. Subsequently the cutting carriage 36 is moved back again into its initial position. In the working position the suction chamber 32 is provided with underpressure so that the beginning of the band of the cut strip is retained by the suction chamber 32 to the supporting and cutting table 25.

After the crosscutting the full reels 5 can be removed. For this purpose the bridgepiece 10 may be placed into a reel changing position. The full reel 5 is taken out and an empty reel sleeve 6 is mounted. The bridgepiece 10 is swivelled back in anticlockwise direction as far as the empty reel sleeve 6 abuts the gap 21. Also this swivelling back is performed under the control of the light barrier 22. Then the machine is ready for the formation of new reels. The drive for the reel sleeve 6 and the machine drive are switched on. The beginning of the material strip is still retained on the supporting and cutting table 25. Upon starting of the machine the supporting and cutting table 25 and 25', respectively, swivels back in accordance with the rotation of the setting shaft 8 in anticlockwise direction into the waiting position according to FIG. 1. Thereby the beginning of the band which is retained on the suction chambers 32, is carried along together with the adhesive labels and reaches safe abutment of the reel sleeve 6, where the adhesive labels retain the beginning of the material band on the periphery of the reel sleeve 6. The short adhesive labels safely abut the circumference of the reel sleeve. Thereby a perfect starting of the winding-on operation is guaranteed. After swinging back of the swivelling shaft 49 all parts are again in the waiting position, illustrated in FIG. 1.

The invention eases and speeds up the crosscutting and the roller change. In particular, a safe retaining of the end of the band and of the beginning of the band upon the full reel and on the empty reel sleeve, respectively, are secured. Thus, the invention substantially contributes to the increase of safety and reliability of the winding operation as well as to an accelerated roller change.

What we claim is:

1. In a machine for forming rolls of strips from longitudinally cut sheets and having at least one rotatable support roll for a strip, a gravity actuated arm urging a take-up roll toward said support roll, means for swinging said arm away from said support roll, means for transversely cutting said strip, and a sickle shaped table rotatable concentrically about said support roll from a position free of contact with said sheet material to a position to cooperate with said cutting means and between said strip and support roll, the improvement comprising:

at least one adhesive label dispenser swingable about an axis parallel to the axis of said support roll for movement to said support roll to place spaced adhesive labels on said strip;

means for moving said take-up roll away from said support roll to form a gap therebetween to accommodate said sickle shaped table;

a slidable cutter movable parallel to the axis of said support roll;

said sickle shaped table having a slit therealong between said spaced labels, to accommodate a portion of said cutter and a suction chamber on the side of said slit downstream of the direction of movement of said sheet; said table being arranged to apply pressure to a starting sleeve for a take-up roll to adhere one of said labels to said sleeve.

2. A machine as defined in claim 1 including optical means for detecting and controlling the width of said gap.

3. A machine as defined in claim 1 wherein said cutter is guided by guide means engageabhe in said slit.

4. A machine as defined in claim 3 wherein said cutter is provided with rollers engageable with the surface of said table.

5. A machine as defined in claim 3 wherein a flexible filament secured to said slide cutter extends along and within said slit for pulling said cutter therealong; said filament being arranged to be pulled by a drum coaxial with said support roll.

6. A machine as defined in claim 1 wherein a plurality of said label dispensers are provided, each being axially adjustable along said axis parallel to the axis of said support roll.

7. A machine as defined in claim 1 wherein said label dispenser includes a contact roll arranged to be pressed against said sheet material and driven thereby and conveyor means for labels driven by said contact roll to direct labels around said contact roll to said sheet material.

8. A machine as defined in claim 7 wherein said label dispenser includes a winding hub and an unwinding hub coaxial therewith, said conveyor means being guided by guide pins to laterally displace labels from said unwinding hub.

9. A machine as defined in claim 8 wherein said conveyor means is a flexible band trained over said contact roll which is arranged to drive said winding hub.

10. A machine as defined in claim 8 wherein said unwinding hub includes a brake.

* * * * *